US007191688B1

(12) United States Patent
Hall, Jr.

(10) Patent No.: US 7,191,688 B1
(45) Date of Patent: Mar. 20, 2007

(54) FORCE AUGMENTATION AND JAW ADJUSTMENT MEANS FOR HAND HELD TOOLS

(76) Inventor: Herbert L. Hall, Jr., 1371 Pleasant Valley Rd., Newark, OH (US) 43055

( * ) Notice: Subject to any disclaimer, the term of this patent is extended or adjusted under 35 U.S.C. 154(b) by 58 days.

(21) Appl. No.: 10/933,754

(22) Filed: Sep. 3, 2004

Related U.S. Application Data

(60) Provisional application No. 60/500,116, filed on Sep. 3, 2003.

(51) Int. Cl.
*B25B 7/10* (2006.01)

(52) U.S. Cl. ..... 81/411; 81/358

(58) Field of Classification Search ..... 81/126, 81/128, 129.5, 342.356, 358, 364–366, 393, 81/411, 413, 416
See application file for complete search history.

(56) References Cited

U.S. PATENT DOCUMENTS

| | | | | | |
|---|---|---|---|---|---|
| 623,337 | A | * | 4/1899 | Rydberg | 81/356 |
| 785,586 | A | * | 3/1905 | Wulst | 81/356 |
| 1,085,198 | A | * | 1/1914 | Finney | 81/356 |
| 1,162,136 | A | * | 11/1915 | Chapman | 81/356 |
| 1,207,064 | A | * | 12/1916 | Metcalf | 81/356 |
| 1,244,966 | A | | 10/1917 | Eifel | |
| 1,344,629 | A | * | 6/1920 | Fowler | 7/131 |
| 1,367,711 | A | | 2/1921 | Nortwed | |
| 1,540,464 | A | * | 6/1925 | Edwards | 81/356 |
| 1,546,139 | A | * | 7/1925 | Leveque | 81/365 |
| 1,680,956 | A | * | 8/1928 | Simonsen | 81/356 |
| 1,862,817 | A | * | 6/1932 | Eifel | 81/356 |
| 2,084,633 | A | * | 6/1937 | Erickson | 81/365 |
| 2,156,529 | A | | 5/1939 | Day | |
| 2,375,082 | A | * | 5/1945 | Colley | 81/356 |
| 2,382,606 | A | * | 8/1945 | Clark | 81/356 |
| 2,397,095 | A | | 3/1946 | Emmett | |
| 2,844,061 | A | * | 7/1958 | Hendrickson | 81/356 |
| 3,161,094 | A | * | 12/1964 | Johnson | 81/412 |
| 3,803,954 | A | * | 4/1974 | Lenker | 81/126 |
| 4,094,215 | A | | 6/1978 | Hudson | |
| 5,176,049 | A | | 1/1993 | Neff | |
| 5,351,584 | A | | 10/1994 | Warheit | |
| 5,461,951 | A | | 10/1995 | Putsch | |
| 5,535,650 | A | | 7/1996 | McNatt | |
| 5,832,793 | A | | 11/1998 | Collins | |
| 5,845,551 | A | | 12/1998 | Putsch | |
| 6,026,716 | A | | 2/2000 | Orlosky | |
| 6,125,724 | A | | 10/2000 | Murphy et al. | |
| 6,155,142 | A | | 12/2000 | Bally et al. | |
| 6,178,855 | B1 | | 1/2001 | Bally et al. | |
| 6,199,459 | B1 | | 3/2001 | Azkona | |
| 6,227,081 | B1 | | 5/2001 | Bally et al. | |
| 6,497,165 | B1 | | 12/2002 | Schulz et al. | |
| 6,502,482 | B1 | | 1/2003 | Putsch et al. | |

* cited by examiner

*Primary Examiner*—David B. Thomas
(74) *Attorney, Agent, or Firm*—MacMillan, Sobanski & Todd, LLC

(57) ABSTRACT

A hand held tool has a slotted handle having a jaw and at least one slot therein, the slotted handle defining a toothed rack within the slot; an operative handle having a jaw and a pinion gear, the pinion gear having at least one tooth suitably shaped to engage the toothed rack, the pinion gear being slidably movable along the slot; and, at least one post member for connecting the operative handle to the slotted handle.

26 Claims, 9 Drawing Sheets

FORCE AUGMENTATION AND JAW ADJUSTMENT MEANS FOR HAND HELD TOOLS

This application claims priority from provisional patent application Ser. No. 60/500,116, filed Sep. 3, 2003.

TECHNICAL FIELD AND INDUSTRIAL APPLICABILITY OF THE INVENTION

The present invention relates primarily to pliers and wrenches. More particularly, this invention relates to non-locking pliers and wrenches in which the jaw opening is variable and manually adjustable over a finite range of selectable jaw gap settings.

BACKGROUND OF THE INVENTION

There are two general styles of pliers. The first style of prior art pliers is generally known within the tool trade as a slip-joint pliers or tongue-and-groove pliers as popularized by Channellock, Inc. The second style of prior art pliers is known as a plier-wrench since it combines features of both pliers and wrenches. For the purpose of this invention disclosure the term pliers describes a hand tool in which the jaws are pivotable about an operative axis. The term plier-wrench describes a hand tool in which the jaws may be tightened onto an object, and where the jaw faces are maintained in a parallel relationship with each other. An example of the latter tool is manufactured by Knipex.

Prior art slip-joint pliers are very popular with professionals, hobbyists, and homeowners alike. This style of pliers has enjoyed a wide acceptance because of the ease, speed, and effortless manner with which the jaw gap settings may be changed, even with gloved hands. Also, this style of pliers has a relatively large range of available jaw gaps which allows one tool to be used for a variety of applications. A still further attraction is that these tools are not expensive to manufacture. Within this tool category, there are a number of product choices. Different jaw orientations are available depending on the particular needs of the user. One popular style of slip-joint pliers affords a jaw orientation, which enables easy access to the object being gripped. A second style, known as a "Nut Buster" by Channellock, Inc. permits a higher clamping force on the object, but has an awkward jaw orientation which renders the tool impractical for many applications.

While the slip-joint pliers are a popular tool, one drawback that applies to all slip-joint pliers is that there are relatively few selectable jaw positions available to the user. Consequently, depending on the size of the object being grasped by the pliers, the handle separation distance is often too great for a comfortable and safe, or an ergonomic, hand grip thereon. A poor, or non-ergonomic, hand grip also contributes to a lower jaw clamping force being applied to the gripped object. This lower jaw clamping force can allow slipping of the pliers' jaws on the workpiece when a torque is applied to the workpiece (i.e., nut, bolt, pipe, rod, etc.). A further drawback of the prior art slip-joint style of pliers are the frictional drag and wear associated with the arced tongue and grooves engagement means between the two jaw-handles.

Yet another prior style of tool is the prior art plier-wrench, which is a two-handled parallel-jaw wrench that has the general overall shape and appearance of pliers. The smooth-faced jaws of this hand tool maintain the jaws in a parallel relationship with respect to each other while being opened and closed, in the manner of wrenches. However, the prior art plier-wrench is two-handled in the manner of pliers.

The prior art plier-wrench has five primary parts: an operative (pivoting) handle, a selectable jaw gap setting pivot pin, a leaf spring, a movable jaw, and a one-piece jaw-handle. The jaw-handle consists of a handle and jaw at opposite ends separated by a medial section. The medial section has a slot where both of the elongated interior edges of the slot are toothed. The pivot pin is toothed as well, along a portion of its length and is designed to simultaneously engage, on its opposite sides, the comparably toothed slot. The medial section of the jaw-handle part also consists of two tongues (one on each side of the jaw-handle, in an opposed relationship) which cooperate with matching grooves on the opposed interior surfaces of the movable jaw. The tongues and grooves in the plier-wrench restrict the movable jaw to a straight-line motion while maintaining the jaws in parallel alignment when the jaws are tightened onto the workpiece. The lines defined by the matching tongues and grooves is parallel to the centerline of the slot. The slot and tongues are adjacent to each other, separated by a short distance.

In operation, the prior art plier-wrench operative pivot handle pivots at any one of a finite number of user-selected pivot points along a line which constitutes the slot's centerline. Two tangs which project away from the operative handle's pivot, on either side of the one-piece jaw-handle, engage a pair of mating recesses in the movable jaw. The movable jaw, therefore, is made to move in a rectilinear fashion along a path defined by the lay of the tongue and groove engagement between the movable jaw and the medial section of the stationary jaw-handle, while, the operative handle is made to rotate, or pivot about a point during a tightening, grasping, or clamping action. Because the operative handle only rotates during a tightening action, the short tang lever arms must be of a sufficient length in order to provide a satisfactory jaw travel distance. Therefore this wrench has practical limits in regard to how short the tang lever arms can be made. As a consequence, the mechanical advantage potential of this wrench design is similarly limited.

A force augmentation, or force multiplication, of the prior art plier-wrench at its jaw is achieved by means of the lever arm principle which states that input torque must equal output torque. Torque is defined as the product of the normal force applied to, or exerted by, a moment arm and the distance from the fulcrum at which the force acts. The input torque applied to the hand-grips, at the end of the handles, can be expressed as: $\text{Force}_1 \times \text{Moment Arm}_1$ while the output torque of the short tang can be expressed as: $\text{Force}_2 \times \text{Moment Arm}_2$, where the Moment $\text{Arm}_1$ is longer than the Moment $\text{Arm}_2$ by several times. When the two expressions are set as an equality, it can be easily seen by those knowledgeable in the art, that the force exerted by the tang onto the operative jaw will be several times that of the hand grip force applied to the operative handle at a distance of Moment $\text{Arm}_1$.

While the prior art plier-wrench design permits jaw clamping force multiplication over other simple lever plier designs (due to a larger Moment $\text{Arm}_1$/Moment $\text{Arm}_2$ ratio), its' design has a number of drawbacks. These drawbacks include: the cost of manufacturing, due to the complex parts, is high; the tongue and groove design is prone to dirt contamination; the jaw gap adjustment procedure is cumbersome to operate; and, the force transfer means between the operative handle and movable jaw is inefficient. In particular, the tongue and groove approach used by the plier-wrench contributes to high manufacturing costs and a tendency for dirt and other small debris to become trapped within the blind recesses and tight clearances therein. Debris within the tongue and groove feature interferes with its smooth movement and can make jaw gap changes extremely difficult. Also, it is difficult to clean such plier-wrench due to the blind recesses and welded jaw construction. As a result, this style of plier-wrench is not suitable for any type of dirty work conditions.

Yet another drawback is that making jaw gap adjustments is a cumbersome process when compared to the familiar and effortless sequential rotate-slide/shift-rotate method used by slip-joint plier manufacturers. The prior art plier-wrench requires depressing the pivot pin button (against the resistance of the leaf spring), and while holding the pin depressed, sliding the operative handle and engaged movable jaw to a new jaw gap position. Once the pivot pin is positioned at the new jaw gap position, the pivot pin button is then released. While the sequential rotate and slide method is advantageous since experienced users can perform jaw gap changes with that style of pliers single-handedly, with gloves; it is more difficult to perform a jaw gap change, single-handed, with the plier-wrench, whether or not gloves are worn, particularly, if the pin does not depress easily because of dirt.

Other drawbacks relate to the inefficient force transfer design of the tangs and their respective engagement slots in the movable jaw of prior art tools, including, for example: limitation of the jaw force multiplication factor (mechanical advantage), or conversely, limitation of the jaw travel during a tightening action; increased wear and friction; a "disconnected" feel between the handle and jaw; and, the need for a wide medial section to accommodate the side by side arrangement of the movable jaw and operative handle.

Still another drawback is that the prior art plier-wrench design is inefficient in regard to the translation of a rotary motion (operative handle) to a rectilinear motion (movable jaw). The plier-wrench handle's pivot axis remains fixed while its tangs travel through an arc, which is, in turn, coupled to an engagement slot, which only travels in a straight line, as determined by the movable jaw's tongues and grooves. As described previously, the practical tang length required for such design unnecessarily limits the mechanical advantage potential of the two-piece jaw-handle. Additionally, the tangs and their engagement slots in the movable jaw are a prime source for frictional wear.

Yet another drawback of the prior art plier-wrench design is the "disconnected", or sloppy, feel between the operative handle and its movable jaw. This disconnected feel worsens as wear opens up the clearance between the respective parts.

A still further drawback of the prior art design is the unwieldy, wide, medial section of the jaw-handle part which is needed for a side-by-side arrangement of the tongues and the elongated slot's centerline.

SUMMARY OF THE INVENTION

In one aspect, the present invention relates to a hand held tool. The hand held tool has an operative handle with a jaw and a slotted handle having a jaw and a slot therein. The slotted handle defines a toothed rack within the slot. The operative handle includes a pinion gear which is slideably movable along a centerline through the slot. The pinion gear includes at least one or more teeth suitably shaped to engage the teeth of the rack. In certain embodiments, the pinion gear is integrally formed with the operative handle.

In certain other embodiments, the hand held tool has an operative handle that comprises a handle member and an operative jaw. The tool also has a slotted handle having a jaw and a slot. The slotted handle defines a toothed rack within the slot. The operative handle also includes a pinion gear having at least one or more teeth suitably shaped to engage the teeth of the rack.

In yet another aspect, the present invention relates to a hand held tool having an operative handle and slotted handle where the slot has a curved, or arcuate shape. A movable pinion is operatively mounted within the curved slot in the operative handle such that the pinion gear is slideably movable along an arcuate centerline through the slot.

DETAILED DESCRIPTION OF THE INVENTION

According to one aspect, the present invention provides novel rack and pinion gear hand tools which satisfy the aforementioned several objectives. The term "tool" as used herein includes hand held tools where a very high jaw force is required, and also includes where only a modest gain in jaw force is required over that of standard slip-joint pliers.

According to another aspect of the present invention, some hand held tools comprises wrenches which maintain their jaws in a parallel relationship. In other aspects, different styles of pliers are also presented as part of this invention disclosure. In still other aspects, the present invention relates to hand held tools that incorporate a pivoting motion in their operation. Thus, the subject invention is not meant to be limited to the exemplary embodiments, but to the scope of the invention itself.

Figure 1:
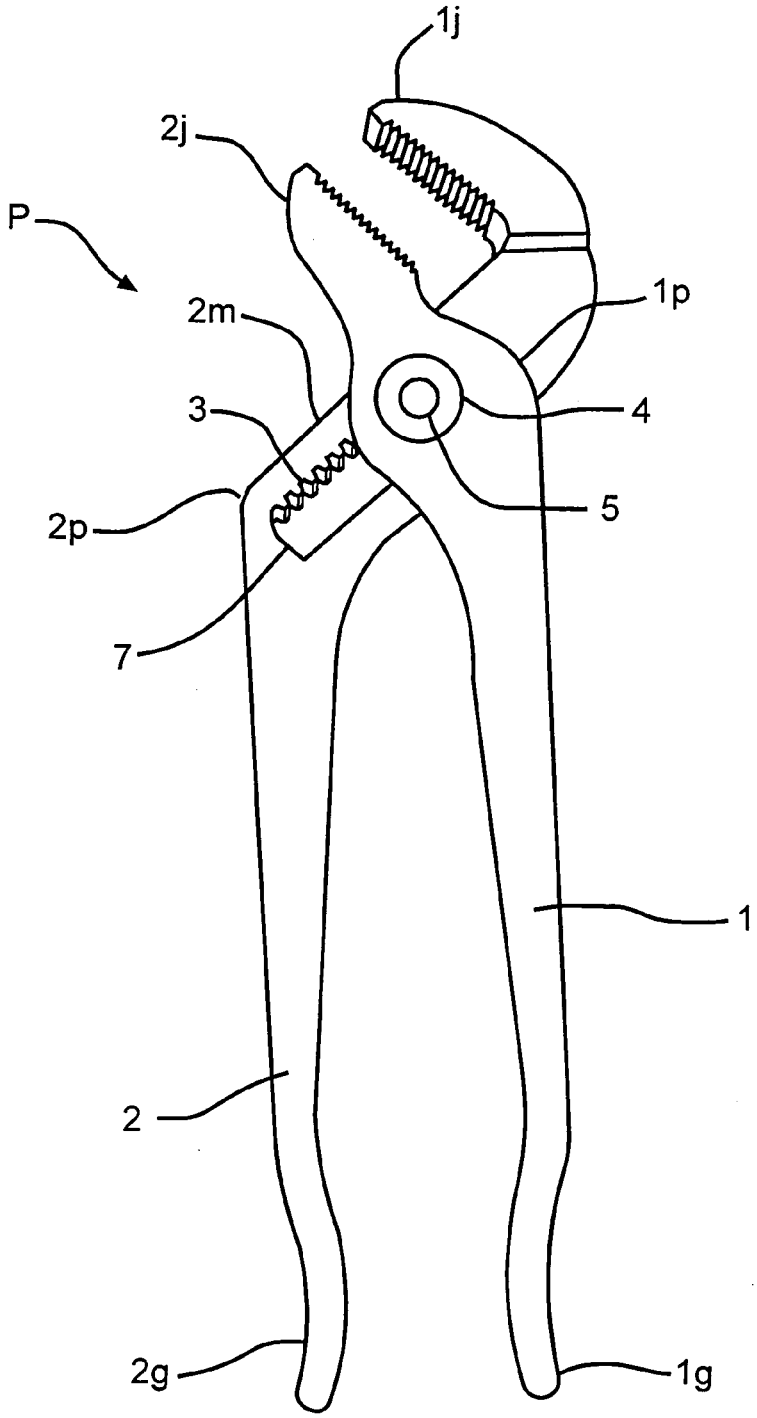
FIG. 1 is a top plan view of one hand held tool.

Referring first to the Figures, FIG. 1 shows one embodiment of a hand held tool of the present invention comprising a Plier assembly P. The plier assembly P includes an operative handle 1 and a slotted handle 2. The operative handle 1 has a jaw, or pivot, end 1*p* and a gripping end 1*g*. The pivot end 1*p* defines a jaw 1*j*.

The slotted handle 2 has a jaw, or pivot, end 2*p* and a gripping end 2*g*. The pivot end 2*p* defines a jaw 2*j*. The jaw end 2*p* of the slotted handle 2 defines a slot 7. The slot 7 extends along a medial section 2*m* of the slotted handle 2. The slot 7 has a first side 7*s* which defines a toothed side, or rack, 3 and a second, or plain, side 7*p*. The toothed rack 3 defines a plurality of alternating teeth 3*t* and spaces 3*s*.

Figure 2:
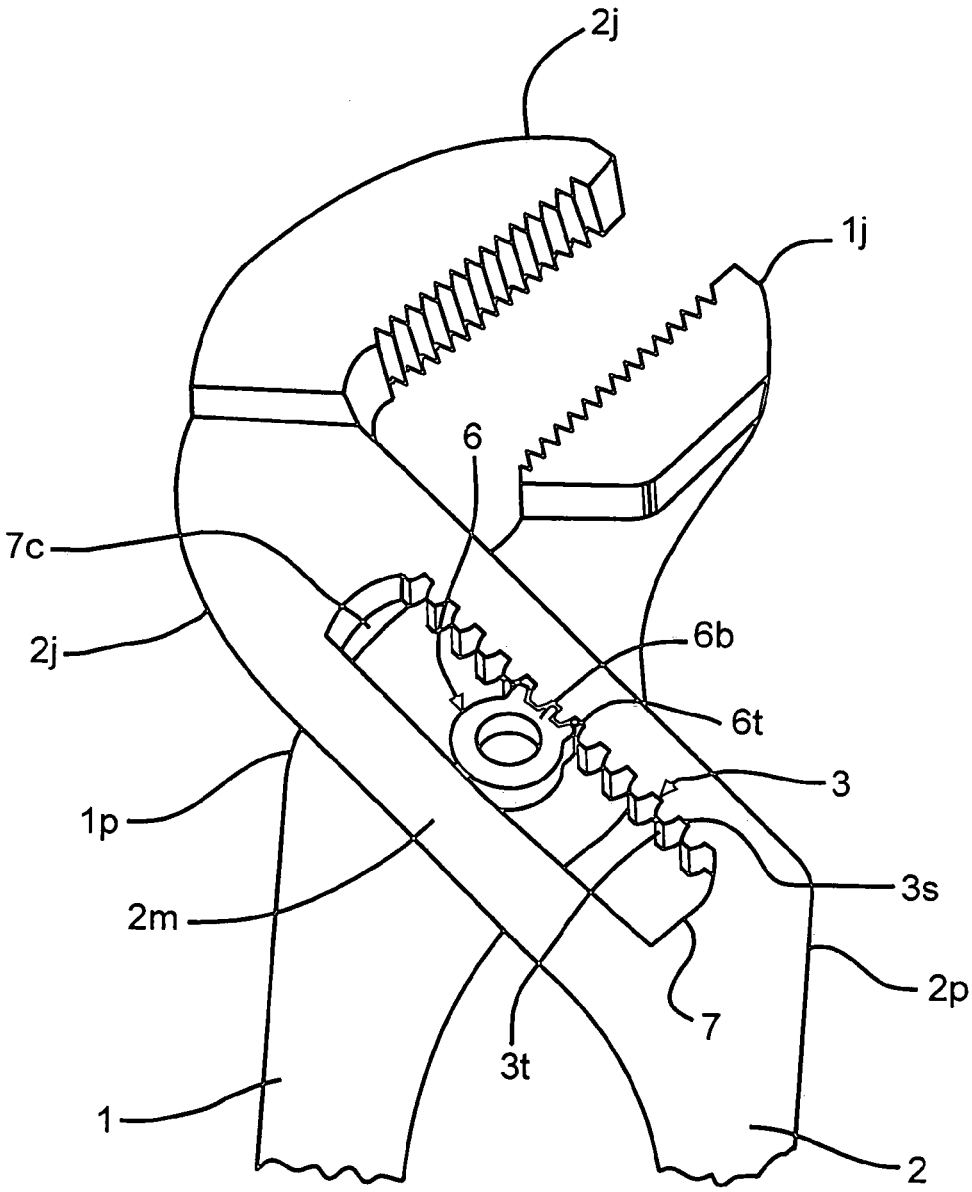
FIG. 2 is a partial, perspective view of the hand held tool shown in FIG. 1 where a flanged post is removed and a partially-toothed pinion gear is shown engaging a rack
Figure 3:
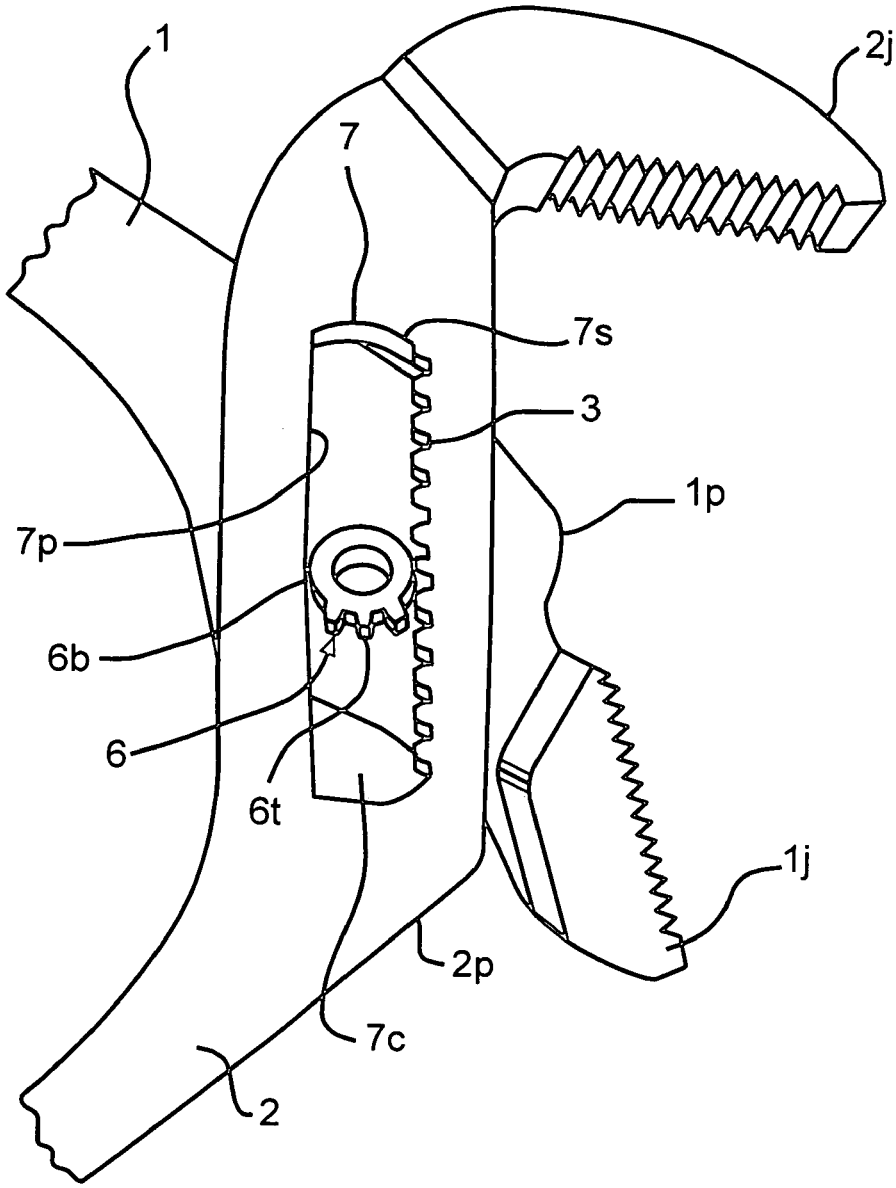
FIG. 3 is a partial perspective view of the hand held tool shown in FIG. 1 where showing the tool in a jaw gap setting position.

The operative handle 1 also includes a pinion gear 6, as best seen in FIGS. 2 and 3, which is operatively mounted to the jaw end 1*p* of the operative handle 1. The pinion gear 6 is axially positioned within the slot 7 to slideably move in the slot 7. It should be understood, however, that other means of securing the pinion gear 6 to the jaw end 1*p* of the operative handle 1 are within the contemplated scope of the present invention.

In the embodiments shown, a post member 5, such as, for example, a flanged post 5, secures the operative handle 1 to the slotted handle 2. In the embodiment shown, a nut 4 is coaxially mounted on the post member 5. FIG. 2 shows an opposite side of the Plier assembly P with the post member 5 removed. The pinion gear 6 includes at least one, and in certain embodiments, a plurality of teeth 6*t*, which are suitably shaped to engage the spaces 3*s* between the teeth 3*t* of the rack 3. In FIG. 2 the pinion gear 6 is shown engaging the rack 3 in a set, or engaged, position.

FIG. 3 shows the Plier assembly P in a jaw gap setting position where the teeth 6*t* of the pinion gear 6 are non-engaged with the teeth 3*t* of the rack 3.

In the embodiment of the present invention shown in FIGS. 1–3, a gain in jaw force is realized. A first force augmentation is due to the shortening of the jaw's moment arm length. This allows a higher moment arm ratio between the handle and the jaw which, in turn, yields higher jaw forces. A second jaw force augmentation entails treating the workpiece being grasped by the pliers as one bar in a 2-bar link and the tool as the second bar in the 2-bar link. When the included angle between the two bars, in the 2-bar link, is greater than 90 degrees, the linkage begins to behave as a quasi-toggle link, with a concomitant dramatic increase in force being applied to, and in-line with, the output link (workpiece) as the included angle approaches 180 degrees. In the Plier assembly P embodiment shown in FIGS. 1–3, the linkage is never permitted to travel over-center in the manner of a locking toggle. As such, the Plier assembly P may be quickly clamped onto and released from a workpiece.

The rack and pinion gear pivot mechanism makes shortening of the operative jaw's moment arm, the quasi-toggle action, and a sequential jaw gap setting procedure possible. The partially-toothed pinion gear 6 is integral with the jaw end 1*p* of the operative handle 1 cooperates with the rack 3 and slot 7 in the slotted handle 2. The pinion gear teeth 6*t* preferably comprise about 90 degrees, or ¼, of the gear's total circumferential distance. The rest of the circumference of the gear 6 is left toothless; i.e., down to the root diameter of the pinion gear, where the root diameter is understood to be the diameter of the pinion gear less the height of the teeth.

The root diameter of the pinion gear 6 corresponds to the nominal width of the slot 7; i.e., where the nominal width is understood to extend from the top of the teeth to the opposing and smooth side 7*p* of the slot 7. The gear teeth 6*t* are aligned with the jaw-handle 1 such that, when the handles 1 and 2 are separated at nearly their widest separation distance, a body portion 6*b* of pinion gear 6 is aligned with a centerline 7*c* of the slot 7. The gear teeth 6*t* are no longer in engagement with the adjacent rack 3, thereby enabling the operative jaw handle 1 with the integral pinion gear 6 to be slid along the slot 7 until arriving at a new jaw gap position. Once the new jaw position is reached, the operative jaw handle 1 is once again rotated into an operative position. Once the operative jaw-handle 1 is rotated into the operative position, the pinion gear teeth 6*t* are then in engagement with a new set of the rack's teeth 3*t*. The new set of teeth 3*t* correspond to a different jaw gap setting, thereby retaining the desirable sequential jaw gap setting procedure.

The rack teeth 3*t* define the elongated side 7*s* of the slot 7 closest to the jaws 1*j* and 2*j*. The smooth side p7 of the slot 7 is left plain or non-toothed. When the Plier assembly P is made to operate, by closing the handles 1 and 2 and the jaws 1*j* and 2*j* upon each other, the operative jaw-handle 1 with the integral pinion gear 6 creates a rolling-translating pivot axis (i.e., prolate cycloid motion) which coincides with the rack's straight-line pitch dimension. Therefore, the jaw's moment arm pivot axis is offset toward the jaw by one half of the pitch diameter of the pinion gear 6. This effectively shortens the jaw's moment arm length and increases its jaw force. One advantage is that the lower jaw's moment arm no longer extends all the way to the centerline of the elongated slot as is the case in prior art slip-joint pliers.

Figure 9:
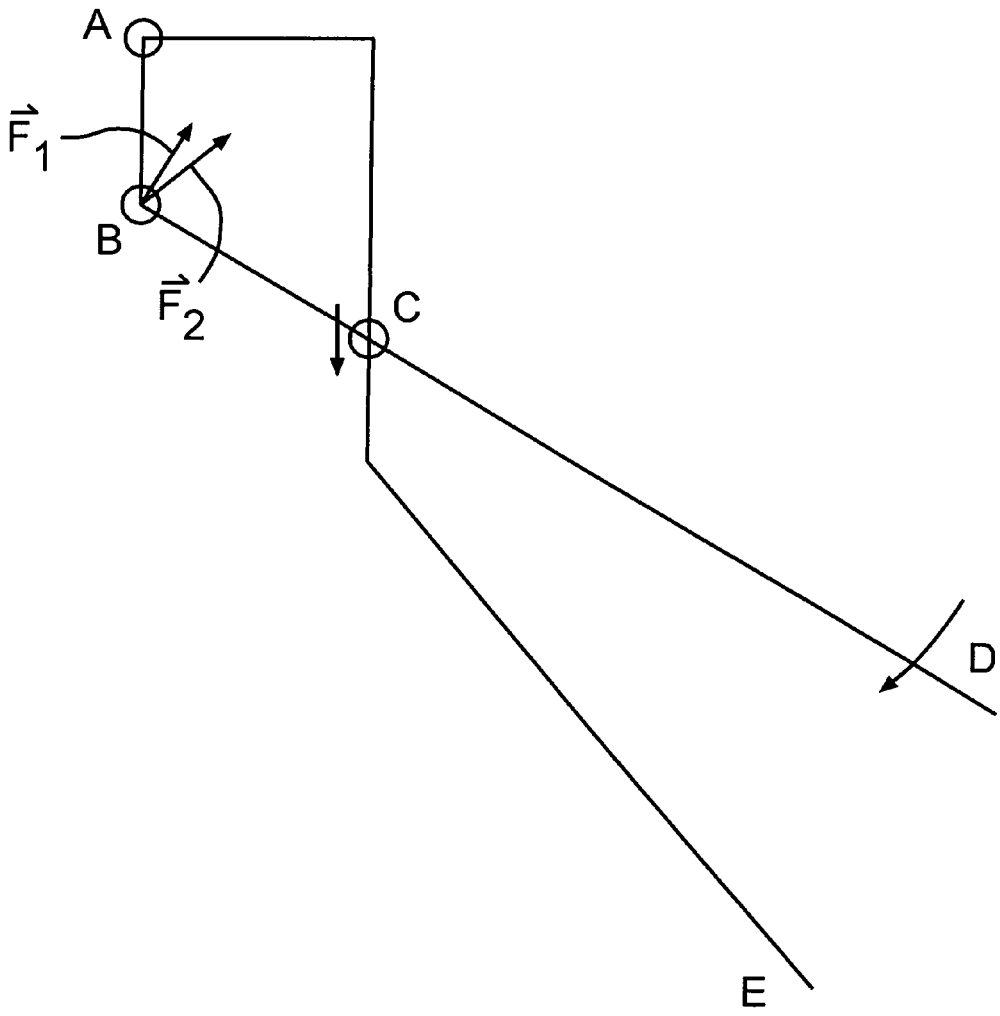
FIG. 9 is a schematic illustration of forces on hand held tools.

Referring to FIG. 9, a schematic illustration of hand tools is shown as having 2-bar links. The present invention provides a unique 2-bar link where the pivot axis C also translates. The two principal links are: AB and BD, with BC as one arm, or link, of lever arm BD. Link AB represents the workpiece in contact with the jaws at position A and position B. Link BD represents the operative jaw-handle. Position C and its arrow represents the translational-pivot characteristic of prolate cyclold motions; in contrast, prior art slip-joint pliers only utilize a simple pivoting action at position C. Position D represents the downward hand grip force. For the sake of simplicity, jaw-handle AE is assumed to be static and fixed, when in practice, it is understood that an equal but opposite force to D is customarily applied at E as well.

Force $\text{vector}_1$ represents the magnitude and direction of the force exerted by conventional prior art plier jaws at position B. Force $\text{vector}_2$ represents a larger magnitude and more advantageous direction of force at position B that is afforded by the present invention. The larger force is derived by virtue of the shorter effective moment arm of BC due to the handle's pivot axis being offset to one side of the slot, as opposed to being centered within the slot according to prior art conventions. A more advantageous direction of force is derived by virtue of the prolate cycloid motion of BD. A simple pivoting lever arm exerts a force at B which is perpendicular to BC. Force $\text{vector}_2$, as a result of a prolate cycloid motion, is less than 90 DEG; i.e., the Force $\text{vector}_2$, more nearly bisects angle ABC. When angle ABC is more nearly bisected, significantly higher forces are developed in links AB and BC. Hence, there is a quasi-toggle link action.

The incorporated rack and pinion mechanism results in a Plier assembly P where additional jaw force augmentation is obtained within the dimensional constraints of the pliers.

As the jaws 1*j* and 2*j* are clamped onto a workpiece, not only does the operative handle 1 rotate, but the operative handle 1 also moves in a rectilinear fashion as well. The simultaneous, dual, rolling-pivot action of the rack and pinion provides a straight-line motion of the pivot axis away from the jaws 1 and 2, and causes a straightening of a first link (the lower jaw) and the second link (workpiece). This additional degree of freedom, even though small in magnitude, over a conventional plier's fixed pivot axis, permits the desirable quasi-toggle action to occur.

In order to further encourage the development of a 2-bar link, quasi-toggle, action with the Plier assembly P, there are at least three pivot points; one at the joint connecting the two links, and one at the opposite ends of the two links. Since the workpiece is the output link, its two contact points with the upper and lower jaws must be allowed to pivot, even if only slightly. One means of ensuring that this occurs with flat-sided work pieces such as hex head bolts and nuts is to incorporate shallow, smooth-faced, notches in the jaws' toothed gripping surfaces. In certain embodiments, the included angle between the two faces of the notches is preferably between about 121 degrees and about 135 degrees, and in certain embodiments, preferably about 125 degrees.

One advantage of the present invention is that the measured notch, or included angle, allows a minor rocking, or pivoting of the hex corners to occur prior to the application of torque to the bolt or nut. Round objects such as pipes and rods have a natural tendency to rock or roll and therefore, do not require the use of notches. Conventional pipe wrenches utilize the quasi-toggle action when clamping onto round work pieces (pipes); however, jaw clamping force does not ensue until a torque has been applied to the round workpiece. Conversely, the Plier assembly P takes advantage of the quasi-toggle principle and provides a clamping force independent of any applied torque. Additionally, the jaw-handle orientation is preferable for most applications when compared to that of prior types of pipe wrench designs.

Another advantage is that when the Plier assembly P clamps squarely onto the corners of a hex head bolt or nut, as opposed to the flats, the clamping force is directed in a more advantageous direction. The notches are more resistant to a "cam-ing" or ramping action than if the jaws are applying a clamping force normal to the faces of the hex workpiece (fastener, fitting, etc.).

Yet another advantage of clamping squarely onto the corners of hex work pieces is that the Plier assembly's jaws do not need to be opened as far in order to obtain another purchase on the hex workpiece. This helps to speed the loosening and tightening of these items. Smooth-faced notches are non-marring where aesthetics of the hex workpiece is important, while, the remainder of the jaws' faces may still be left toothed for other gripping applications.

Referring now to FIGS. 4–7, another embodiment of a Plier Assembly PA is shown. The Plier Assembly PA includes an operative handle 8 and a slotted handle 9. The operative handle 8 includes i) a handle portion, comprised of a jaw, or pivot, end 8*p* and a gripping end 8*g*, and ii) an operative jaw 14. In the embodiment shown, the pivot end 8*p* is operatively and removeably connected to the operative jaw 14.

Figure 5:
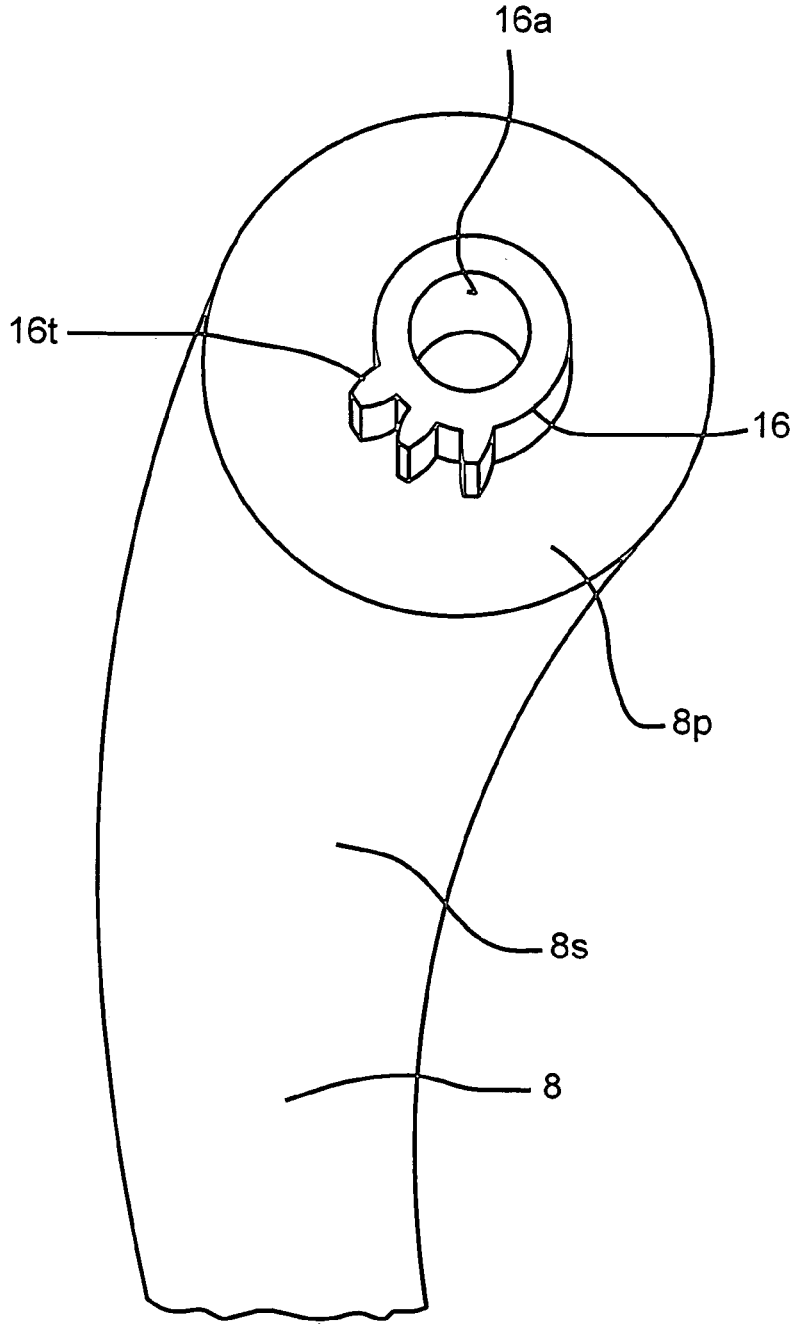
FIG. 5 is a partial, perspective view of an operative handle and an integral pinion gear of the hand held tool shown in FIG. 4.
Figure 6:
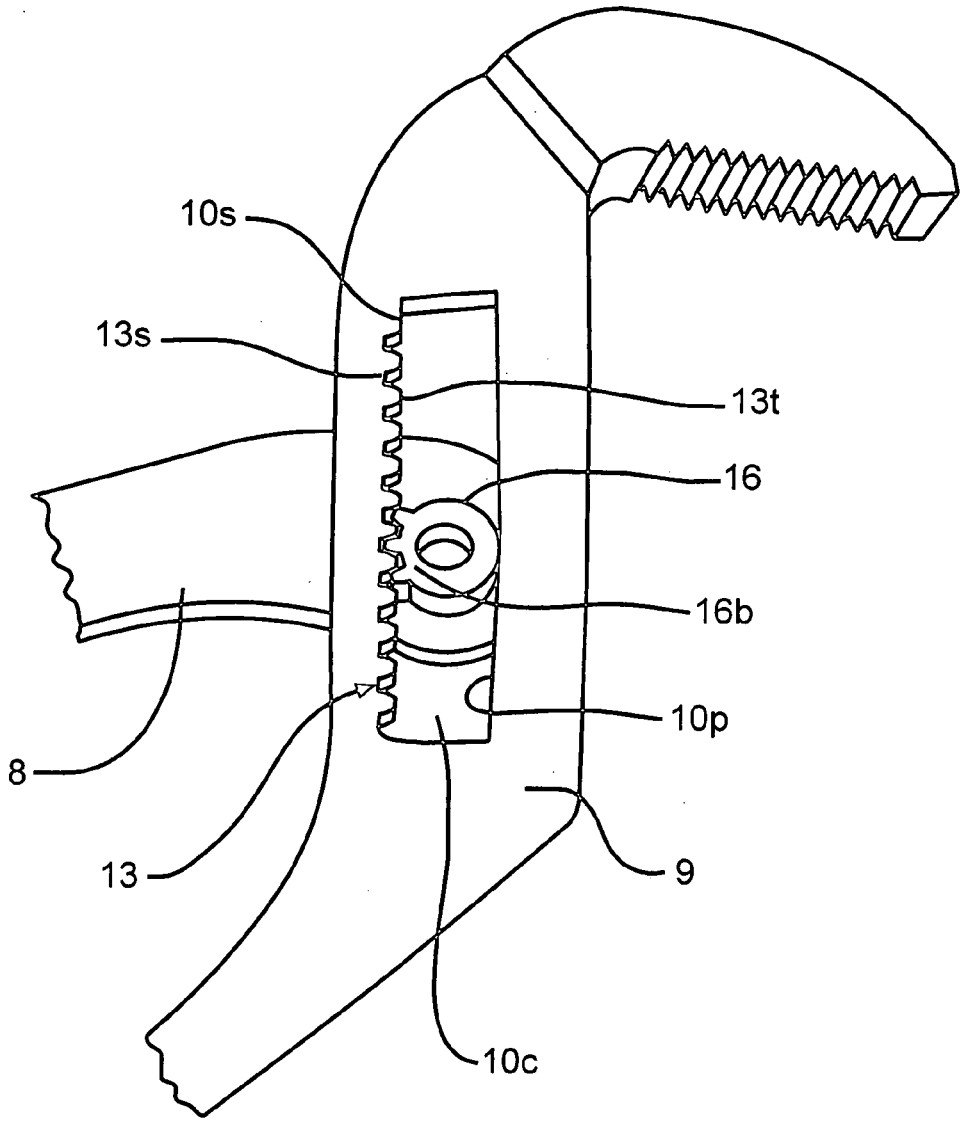
FIG. 6 is a partial perspective view of the hand held tool of FIG. 4 showing an operative jaw removed and a partially-toothed pinion gear in engagement with a rack.

The operative handle 8 also includes a pinion gear 16, as best seen in FIGS. 5 and 6, which is operatively mounted to the jaw end 8*p* of the operative handle 8. The pinion gear 16 is axially positioned within the slot 10 to slideably move in the slot 10. It should be understood, however, that other means of securing the pinion gear 16 to the jaw end 8*p* of the operative handle 8 are within the contemplated scope of the present invention.

In the embodiment shown, a post member 15 and a nut 12 secures the operative handle 8 to the slotted handle 9. FIG. 6 shows the Plier Assembly PA with the post member 15 removed. The pinion gear 16 includes at least one, and in certain embodiments, a plurality of teeth 16*t*, which are suitably shaped to engage the spaces 13*s* between the teeth 13*t* of the rack 13. In FIG. 6, the pinion gear 16 is shown engaging the rack 13 in a set, or engaged, position.

The slotted handle 9 has a jaw, or pivot, end 9*p* and a gripping end 9*g*. The pivot end 9*p* defines a jaw 9*j*. The jaw end 9*p* of the slotted handle 9 defines a slot 10. The slot 10 extends along a medial section 9*m* of the slotted handle 9. The slot 10 has a first side 10*s* which defines a toothed side, or rack, 13 and a second, or plain, side 10*p*. The toothed rack 13 defines a plurality of alternating teeth 13*t* and spaces 13*s*.

Figure 4:
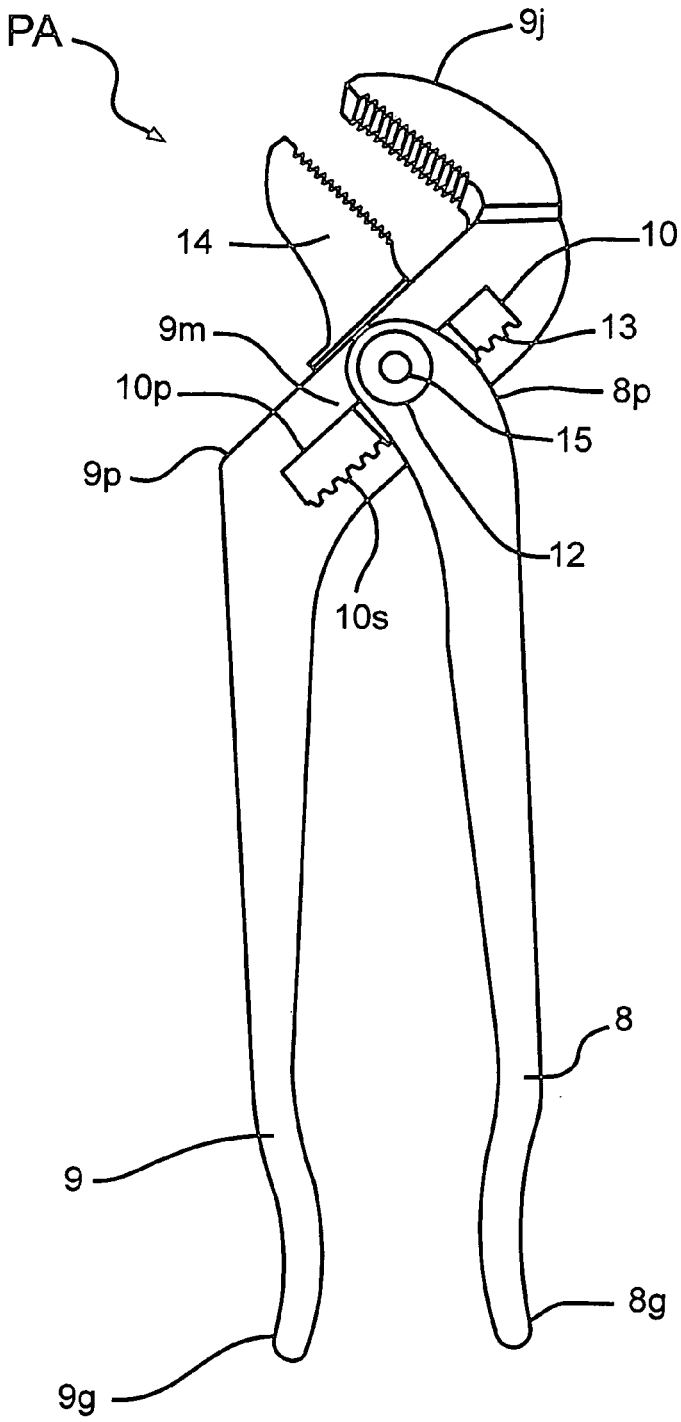
FIG. 4 is a top plan view of another hand held tool.

In the embodiment shown, the post member 15 extends through a flanged portion 14*f* of the operative jaw end 14. As seen in FIG. 4, the nut 12 is coaxially mounted on the post member 15. The post member 15 secures the jaw end 9*p* of the slotted handle 9 to the operative jaw 14 of the operative handle 8.

Figure 7:
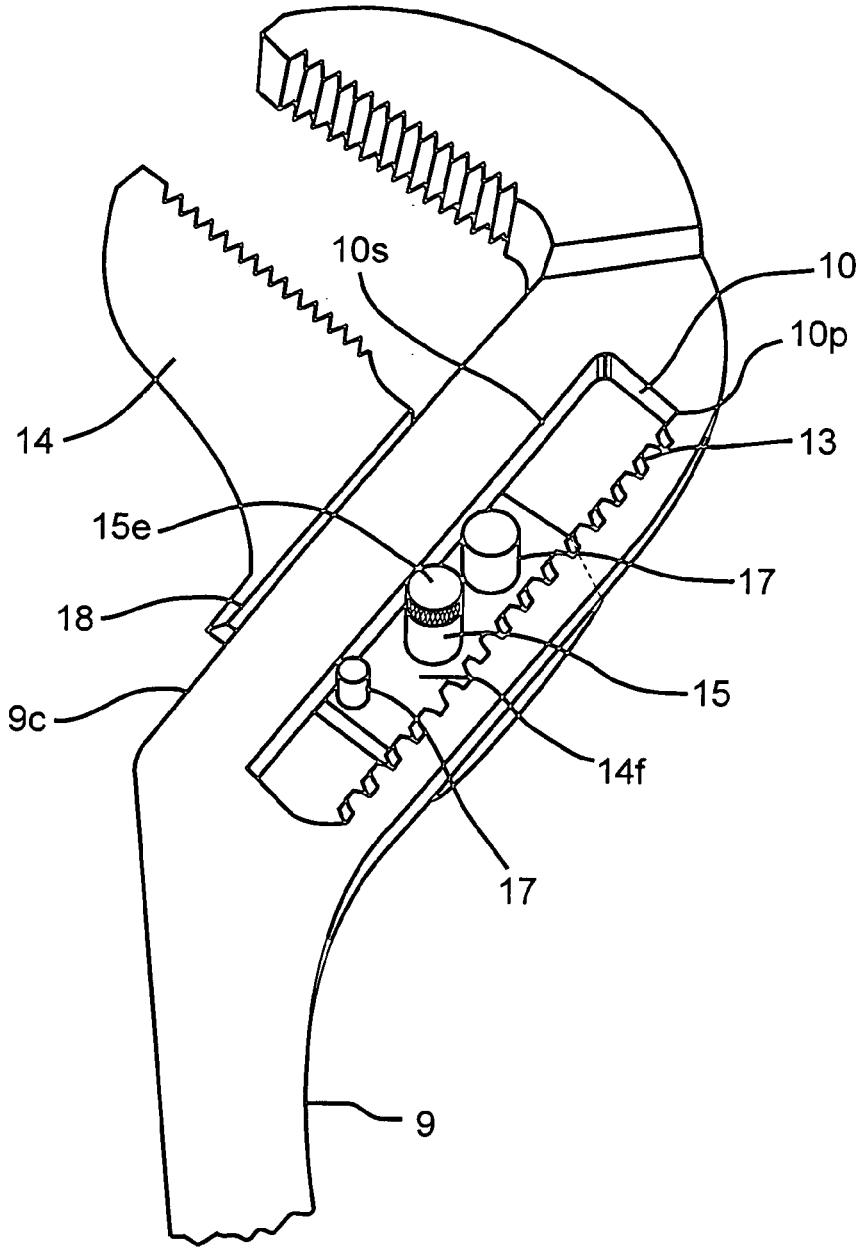
FIG. 7 is a partial, perspective view of the hand held tool of FIG. 4 showing an operative handle removed.

FIG. 7 shows a portion of the handle 8, that is, the operative jaw 14 with the handle portion 8*p*–8*g* of the operative handle 8 removed. In the embodiment shown, the jaw 14 preferably features the threaded-end post 15 which extends from the interior face 14*f* and passes through an axially extending bore 16*a* in the partially-toothed pinion gear 16. The 12 nut preferably threads onto an end of the post member 15. It is to be understood that other suitable connecting members are within the contemplated scope of the present invention for securing one part of a pivoting tool to an adjacent part of such tool; for example, the tool assembly may be made by means of a swaged shoulder with a counter bore in an opposing part of the tool to provide a low profile surface on such tool.

Further, in certain embodiments, the operative jaw 14 can include at least one or more guiding mechanisms such guide projections 17 and/or guide ledge 18. As shown in FIG. 7, adjacent the post member 15 there is at least one, and in certain embodiments, two or more suitable structural projections 17 (such as, by way of non-limiting examples: plain posts, bosses, ridges, steps, tongues, or other elements which project into the cavity formed by the slot 10). The projections 17 extend in a spaced apart and parallel relationship to the post member 15. The projections 17 do not interfere with the rotation of the partially-toothed pinion gear 16. The projection(s) 17, in cooperation with the ledge 18, prevents rotation of the operative jaw 14 when a clamping action is performed on a workpiece. The projection(s) 17 are in sliding contact with the elongated smooth surface 10*s* of the slot 10 opposite the rack 13, while ledge 18 of the jaw 14 is in sliding contact with a cooperating surface 9*c* on an exterior face of the slotted jaw handle 9. It is to be understood that other types of guide mechanisms, including, but not limited to low profile bearings, can be used to reduce any resistance, and the use of such are within the contemplated scope of the present invention.

Referring now, in particular to FIG. 6, the pinion gear 16 is axially positioned to move in the slot 10. FIG. 6 shows the operative jaw 14 removed where the pinion gear 16 is shown in engagement with the rack 13.

The pinion gear 16 includes at least one, and in certain embodiments, a plurality of teeth 16*t*, which are suitably shaped to engage the spaces 13*s* between the teeth 13*t* of the rack 13. In FIG. 6, the pinion gear 16 is shown engaging the rack 13 in a set, or engaged, position. FIG. 6 shows the Plier Assembly PA in an engaged position where the teeth 16*t* of the pinion gear 16 are engaged, or in mating contact, with the teeth 13*t* of the rack 13.

In the embodiment shown in FIGS. 4–7, a very high jaw force augmentation is achieved by the rack and pinion gear pivot-and-translate mechanism. The partially-toothed pinion gear 16 is in rolling contact with the rack 13 which allows the Plier Assembly PA to have a very desirable short output (jaw) moment arm. The jaw augmentation forces achieved with the present invention are nearly as great as a true toggle plier, without the disadvantage of the prior art toggle pliers' "snap-action" clamp-release characteristics, which "snap-action" requires a separate release action by the user.

The position of the rack 13 is reversed from the rack 3 of the embodiment shown in FIGS. 1–3. Instead of comprising the jaw-side of the elongated slot, the rack 13 is incorporated into a side 10*p* that is the opposite, elongated, side of the jaw-handle slot 10.

The Plier Assembly PA comprises a 2-piece jaw-handle, the operative handle 8 and the jaw 14. The 2-piece jaw-handle, comprising the handle 8 and jaw 14, is pivotably joined at a pivot axis of the pinion gear 16. This provides a very compact and efficient design. The operative handle 8 is positioned on the one side of the slotted jaw handle 9, while its operative jaw 14 is positioned on the opposite side of the slotted jaw handle 9. The 2-piece jaw-handle comprised of the operative handle 8 and the jaw 14 move together in a rectilinear fashion.

The partially-toothed pinion gear 16 is integrally attached or incorporated into the operative handle 8's interior facing side 8*s*. The rack and pinion gear pivot mechanism makes shortening of the operative jaw's moment arm, the quasi-toggle action, and a sequential jaw gap setting procedure possible. The partially-toothed pinion gear 16 is integral with the jaw end 8*p* of the operative handle 8 and cooperates with the rack 13 and slot 10 in the slotted handle 9. The pinion gear teeth 16*t* preferably comprise about 90 degrees, or ¼ of the gear's total circumferential distance in order to permit the familiar and desirable sequential jaw gap setting procedure. The rest of the circumference of the gear 16 is left toothless (down to the root diameter). The diameter of the pinion gear 16 corresponds to the nominal width of the slot 7.

The gear teeth 16*t* are aligned with the jaw-handle 8 such that when the handles 8 and 9 are separated at nearly their widest separation distance, the body 16*b* of the pinion 16 is aligned with a centerline 10*c* of the slot 10. The gear teeth 16*t* are no longer in engagement with the adjacent rack 13, thereby enabling the operative jaw handle 8 and jaw 14, along with the pinion gear 16, to be slid along the slot 10 until arriving at a new jaw gap position. Once the new jaw position is reached, the operative jaw handle 8 and jaw 14 are once again rotated into an operative position. Once the operative jaw-handle 8 and jaw 14 rotated into the operative position, the pinion gear teeth 16*t* are then in engagement with a new set of the rack's teeth 13*t*. The new set of teeth 13*t* correspond to a different jaw gap setting, thereby retaining the desirable sequential jaw gap setting procedure.

The rack teeth 13*t* define the elongated side 10*p* of the slot 10 farthest from the jaws 8*j*. The near side 10*s* of the slot 10 is left plain. The Plier Assembly PA is made to operate by moving the handle 8 and the handle 9 in a direction toward each other such that the jaws 8*j* and 9*j* close upon each other. The operative jaw-handle 8 and jaw 14 together with the pinion gear 16 creates a rolling-translating pivot axis (i.e., prolate cycloid motion) which coincides with the rack's straight-line pitch dimension, as fully described above.

The jaw's moment arm pivot axis is offset toward the jaw by one half of the pitch diameter of the pinion gear 16. This effectively shortens the jaw's moment arm length and increases its jaw force. One advantage is that the lower jaw's moment arm no longer extends all the way to the centerline of the elongated slot as is the case in prior art slip-joint pliers.

Since the operative handle 8 and the jaw 14 are joined in a pivoting fashion, as the operative handle 8 is rotated, the jaw 14 is also made to move in a rectilinear fashion. This unitary movement provides a satisfactory "feel" when using the tool. Additionally, since the operative handle 8 and the jaw 14 pivot on one another, and not side-by-side, the Plier Assembly PA has a very compact construction.

In the embodiment shown in FIGS. 4–7, the distal face of the pinion gear 16 is not seated against another surface. Since the operative jaw 14 is not made to rotate, there is a small clearance between the end of the partially-toothed pinion gear 16 and the inside face of the operative jaw 14.

Very high jaw augmentation forces are achieved due to the potential for very short effective jaw moment arm lengths. The rolling action of the pinion gear 16 provides the necessary jaw travel, even with a low pinion/rack gear tooth profile. This jaw travel is better than the limited travel which is afforded by a stationary pivot axis and tang approach. Also, the Plier Assembly PA allows for a consistently high jaw force regardless of the operative handle's position, which can be an advantage in some applications. In addition to the leverage advantage a short moment arm allows, the rolling action of the partially-toothed pinion gear on the rack gear, which transfers its force through the preferably threaded post, is more efficient than the dual tang, cam-action, approach used by prior type tools.

Another advantage is that the Plier Assembly PA has an open construction and does not trap debris. While a non-separable, press-fit (or other permanent retention means), end cap may optionally be used in place of the threaded nut, the rack threads are sufficiently accessible to be cleaned, if necessary, without disassembly of the major part. Also, for example, all major parts of the Plier Assemblies P and PA may be made from forged metal or by blanked laminations for greater strength and for lower costs of production.

Still other the advantages afforded include: sequential jaw gap setting procedure; very high jaw force augmentation; non-toggle action (fast operation, easy release); a compact design; low cost construction; a parallel jaw orientation; a design suitable for use in dirty conditions; a design that is easy to clean; an efficient force transfer design between the operative handle and its jaw; and, a satisfactory "feel" when using the tool.

Figure 8:
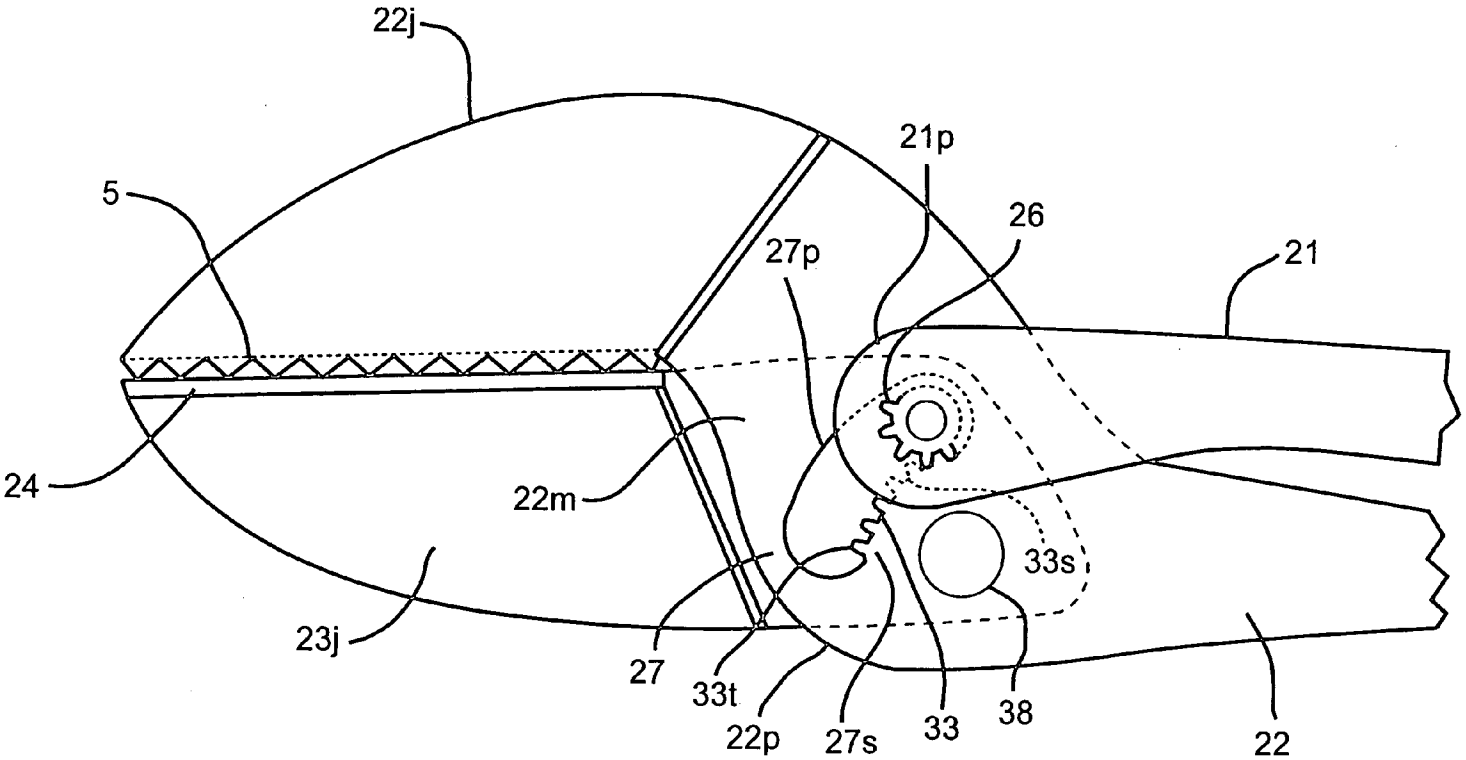
FIG. 8 is a partial, plan view, partially in phantom, showing an alternative embodiment which features a curved slot.

FIG. 8 depicts an alternative embodiment of a tool, such as a Snip Assembly SA, which includes an operative handle 21 and a slotted handle 22. The operative handle 21 has a jaw, or pivot, end 21*p* and a gripping end (not shown) and a pinion gear 26. The pivot end 21*p* is operatively attached to a lower jaw 23*j*.

The slotted handle 22 has a jaw, or pivot, end 22*p* and a gripping end (not shown). The pivot end 22*p* defines a straight knife blade edge 24*j*. The jaw 22*p* of the slotted handle 22 defines a curved slot 27. The curved slot 27 extends along a medial section 22*m* of the slotted handle 22. The curved slot 27 has a first side 27*s* which defines a toothed side, or rack, 33 and a second, or plain, side 27*p*. The toothed rack 33 defines a plurality of alternating teeth 33*t* and spaces 33*s*.

The pinion gear 26 engages the curved slot 27 and the gear teeth 33*t*, in a manner as described above for the other embodiments The lower jaw 23 pivots about a stud 38.

The slotted handle 22 features a combination of serrations 24 and an anvil 25. The anvil 25 comprises a groove extending down the middle of the serrations 24. In certain embodiments, the serrations 24 comprise a straight knife blade edge which seats against the anvil surface 5. In the embodiment shown in FIG. 8, the lower jaw 23*j* is shown in the fully closed position. In many such embodiments, the shown Snip Assembly, or lopper, SA is designed to cut twigs and branches with minimal effort. The serrations prevent the branch from sliding out from the nip point while the anvil surface 25 allows the blade 24 to make a clean cut. One advantage of the curved slot 27 and rack 33 is that, as the slotted handle 22 approaches its closed position, the force delivered by the jaws increases dramatically due to the pivoting action of the lower jaw 23*j*. This increase in jaw force near the closure of the tool handily coincides with a requisite increase in force needed to complete the cut.

It should be noted that the present invention is not limited to the examples shown, but rather, that it is to include the spirit and scope of the invention. For example, various iterations of the partially-toothed pinion gear and operative jaw have been contemplated which include the optional use of cam-followers to further reduce sliding friction and pinion gears with teeth that do not span the full width of the gear.

It is therefore one object of this invention to provide a tool that retains a desirable parallel jaw orientation (as opposed to a wrap-around jaw orientation style) while improving on the developed clamping force exerted by the jaws on the workpiece.

It is a further object of this invention to provide a tool that retains a desirable jaw orientation while lessening the hand grip force required to achieve an equivalent jaw clamping force.

It is a further object to provide a tool that has a substantial increase in a jaw's grip over that of conventional slip-joint pliers such that the tool of the present invention is less apt to slip off, or round the corners, of hexagonal nuts, bolts, and the like.

A further object of this invention is to provide a tool that retains a sequential-action jaw gap setting action: i) the handles are first spread to nearly their widest separation distance, and then the jaw adjustment is made by a rectilinear sliding action; and, ii) the handles are again closed, or partially closed, to the desired jaw gap, thereby setting the tool for the workpiece for the task at hand.

Yet another object of the present invention is to provide a hand tool which can be used in dirty conditions, and can be easily cleaned, assembled, and disassembled.

Still another object of this invention is to provide a low cost, compact plier design.

Another object of the present invention is to provide a tool that has an extremely high jaw force that does not require a locking-toggle action since locking toggle pliers and wrenches are much slower to operate due to the need for a change of grip in order to release the toggle-lock mechanism.

A still further object is to provide a tool that has an increased number of jaw gap position settings over known pliers and wrenches.

The principle and mode of operation of this invention have been described in its preferred embodiments. However, it should be noted that this invention may be practiced otherwise than as specifically illustrated and described without departing from its scope.

What is claimed is:

1. A hand held tool comprising:

a slotted handle having a first jaw end, a handle end, and at least one slot therein, the slotted handle defining an internal gear tooth rack along one side of the slot; and a second handle having a second jaw end, the second handle having a handle end and a partially toothed pinion gear protruding into the slot from the second handle and fixed with respect to the second handle, the pinion gear having at least two teeth shaped and positioned to engage the gear tooth rack of the slotted handle in a rolling manner when the two jaw ends are brought together, the pinion having a portion of its circumference with no gear teeth, the pinion being configured so that when the handles are opened to a wide separation distance, the pinion gear teeth become disengaged from the rack gear teeth and the pinion can be moved along the length of the slot to a previously presented position corresponding to a different gap between the jaw ends.

2. The hand held tool of claim 1, wherein the pinion gear is integrally formed with the operative handle.

3. The hand held tool of claim 1, wherein the operative handle comprises a handle member and an operative jaw, the operative jaw being operatively connected to the handle member by the post member.

4. The hand held tool of claim 1, wherein the slot has a linear shape.

5. The hand held tool of claim 1, wherein the slot has a curved shape.

6. A hand held tool comprising:

a slotted handle having a jaw end and a gripping end, wherein the jaw end defines a jaw, the jaw end of the slotted handle defines a slot having a gear toothed rack, the toothed rack defining a plurality of alternating teeth and spaces;

an operative handle having a jaw end and a gripping end, wherein the jaw end defines a jaw, the operative handle further having a pinion gear fixed with respect to the operative handle, the pinion gear having at least one tooth suitably shaped to engage teeth and spaces of the toothed rack in a rolling motion, the pinion gear being slideably movable along the slot; and, at least one post member for connecting the operative handle to the slotted handle.

7. The hand held tool of claim 6, wherein the pinion gear includes a plurality of teeth.

8. The hand held tool of claim 6, wherein the hand held tool is structured to grasp at least one workpiece, the workpiece acting as one bar in a 2-bar link and the operative handle acting as a second bar in the 2-bar link, wherein there exists an included angle between the two bars, and the two bars are linked at a pivotable point which coincides with position where the operative handle's jaw contacts the workpiece;

wherein the second bar is constrained to follow a prolate-cycloid motion, due to a simultaneous pivoting and rectilinear action of the pinion gear rolling along the gear toothed rack.

9. The hand held tool of claim 8, wherein the pinion gear is integrally formed with the jaw end of the operative handle.

10. The hand held tool of claim 6, wherein the pinion gear teeth comprise about 90 degrees of the gear's total circumferential distance and wherein a remaining portion of the circumference of the gear is non-toothed.

11. The hand held tool of claim 6, wherein a root diameter of the pinion gear corresponds to a nominal width of the slot.

12. The hand held tool of claim 6, wherein the gear teeth are aligned with the jaw-handle whereby, when the handles are separated at nearly their widest separation distance, a body section of the gear teeth is aligned with a centerline of the slot, whereby the gear teeth are no longer in engagement with the rack, thereby enabling the pinion gear to be slid along the slot until arriving at a Previously presented jaw gap position.

13. The hand held tool of claim 6, wherein the rack teeth define an elongated side of the slot closest to the jaws.

14. A hand held tool comprising:

a slotted handle having a jaw end and a gripping end whereby the jaw end defines a jaw, the jaw end of the slotted handle defining a slot having a gear toothed rack along one elongated side of the slot, the gear toothed rack defining a plurality of alternating teeth and spaces;

a pinion gear handle having a jaw end and a handle end, the pinion gear handle further including a pinion gear mounted to the pinion gear handle and fixed with respect to the gear tooth handle, with the pinion gear being arranged to engage the teeth and spaces of the toothed rack in a rolling motion; and, at least one post member for connecting the pinion gear handle to the slotted handle.

15. The hand held tool of claim 14, wherein the pinion gear includes at least two or more teeth suitably shaped to engage the spaces between the teeth of the rack.

16. The hand held tool of claim 15, the pinion gear is in rolling contact with the rack thereby allowing the tool to have a desirable short output jaw moment arm.

17. The hand held tool of claim 16, wherein the operative handle and the jaw form a 2-piece jaw-handle pivotably joined at a pivot axis of the pinion gear.

18. The hand held tool of claim 17, wherein the operative handle is positioned on one side of the slotted jaw handle, while the operative jaw is positioned on an opposite side of the slotted jaw handle, whereby the operative handle jaw and the slotted jaw move together in a rectilinear fashion.

19. The hand held tool of claim 18, wherein the toothed pinion gear is integrally attached to an interior facing side of the operative handle.

20. The hand held tool of claim 19, wherein the pinion gear is integrally formed with the jaw end of the operative handle and the pinion gear cooperates with the rack and slot in the slotted handle.

21. The hand held tool of claim 20, wherein the pinion gear teeth comprise about 90 degrees of the gear's total circumferential distance and a remaining portion of the gear's circumference is non-toothed.

22. The hand held tool of claim 14, wherein the gear teeth are aligned with the jaw-handle whereby, when the handles are separated at nearly their widest separation distance, a body section of the gear teeth is aligned with a centerline of the slot.

23. The hand held tool of claim 14, wherein the slot has a first elongated side defined by the rack teeth, the first elongated side being closest to the jaws, and a second elongated side that is non-toothed.

24. The hand held tool of claim 23, wherein at least one guide mechanism extends from the interior face of the operative jaw, the at least one guide mechanism extending in a spaced apart and parallel relationship to the post member, wherein the at least one guide mechanism is in sliding contact with the elongated smooth surface of the slot opposite the rack.

25. The hand held tool of claim 14, wherein the pivot member extends from an interior face and passes through an axially extending bore in the pinion gear.

26. A hand held tool comprising:

a slotted handle having a jaw end and a gripping end, the jaw end of the slotted handle having a curved slot which defines a toothed rack, the toothed rack defining a plurality of alternating teeth and spaces, and the toothed rack being fixed with respect to the slot; and an operative handle having a jaw end and a gripping end wherein the jaw end is operatively attached to a lower jaw, the operative end further including a pinion gear which engages the curved slot and the rack.

* * * * *